US011414103B2

(12) United States Patent
Plinninger

(10) Patent No.: US 11,414,103 B2
(45) Date of Patent: Aug. 16, 2022

(54) MIXER AND ASSEMBLY FOR AIR-CONDITIONING A RAIL VEHICLE

(71) Applicant: SIEMENS MOBILITY GMBH, Munich (DE)

(72) Inventor: Thomas Plinninger, Rosenheim (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 16/980,925

(22) PCT Filed: Feb. 14, 2019

(86) PCT No.: PCT/EP2019/053724
§ 371 (c)(1),
(2) Date: Sep. 15, 2020

(87) PCT Pub. No.: WO2019/174848
PCT Pub. Date: Sep. 19, 2019

(65) Prior Publication Data

US 2020/0406939 A1 Dec. 31, 2020

(30) Foreign Application Priority Data

Mar. 15, 2018 (DE) ..... 102018203986

(51) Int. Cl.
*B61D 27/00* (2006.01)

(52) U.S. Cl.
CPC ..... *B61D 27/0018* (2013.01)

(58) Field of Classification Search
CPC ..... B61D 27/0018; F24F 13/04; F24F 1/01
USPC ..... 454/103
See application file for complete search history.

(56) References Cited

U.S. PATENT DOCUMENTS 2,304,151 A 12/1942 Crawford
2,661,676 A * 12/1953 Farr ..... B61D 27/0018 454/99
3,343,473 A 9/1967 Gillick et al.
3,434,300 A * 3/1969 Rueth ..... B61D 27/0018 62/309

(Continued)

FOREIGN PATENT DOCUMENTS

DE 2610108 A1 9/1977
DE 19847504 C1 11/2000

(Continued)

*Primary Examiner* — Allen R. B. Schult
(74) *Attorney, Agent, or Firm* — Laurence A. Greenberg; Werner H. Stemer; Ralph E. Locher

(57) ABSTRACT

A mixer, which forms the core part of an air-conditioning assembly of a rail vehicle, has two inlets, an outlet, and a central region between the inlets and the outlet. A first inlet is connected to a fresh air supply, and a second inlet is connected to a circulating air supply such that fresh air and circulating air reach the central region, where the circulating air is mixed with the fresh air to obtain supply air. The central region is connected to the fresh air inlet via an opening, which forms a transition region between the fresh air inlet and the central region. The transition region contains a profiled section with a wing-shaped cross-section in the transition region where the supplied fresh air generates negative pressure along the transition region, and the circulating air is suctioned into the central region of the mixer with a boost from the negative pressure.

5 Claims, 6 Drawing Sheets

(56) References Cited

U.S. PATENT DOCUMENTS

| | | | | |
|---|---|---|---|---|
| 3,973,865 | A * | 8/1976 | Mugele | F04D 23/008 415/55.1 |
| 2015/0129040 | A1* | 5/2015 | Hartig | B01F 25/282 137/833 |
| 2018/0265205 | A1* | 9/2018 | Friedrich | F04F 5/18 |
| 2019/0126726 | A1 | 5/2019 | Uhlenbusch et al. | |

FOREIGN PATENT DOCUMENTS

| | | | |
|---|---|---|---|
| DE | 102016107227 | A1 | 10/2017 |
| GB | 346904 | A | 4/1931 |
| GB | 2472534 | A | 2/2011 |
| RU | 160323 | U1 | 3/2016 |
| WO | WO2014184101 | A1 | 11/2014 |

* cited by examiner

MIXER AND ASSEMBLY FOR AIR-CONDITIONING A RAIL VEHICLE

BACKGROUND OF THE INVENTION

Field of the Invention

The invention relates to a mixer and an assembly for the air-conditioning of a rail vehicle.

A typical diagram of a known air conditioning system of a rail vehicle together with a mixer used therein is represented in FIG. 5.

Fresh air FL is delivered to a mixer M via a first inlet and circulating air UL via a second inlet. The circulating air UL here originates from the interior IR of the rail vehicle and is delivered to the mixer M by means of a ducting system KS2. The fresh air FL is obtained from the external surroundings of the rail vehicle and is likewise delivered to the mixer M.

The mixer M mixes the circulating air UL delivered with the fresh air FL delivered, and from these generates so-called supply air ZL.

Via an outlet of the mixer M the supply air ZL is delivered to an air conditioning unit KLG and to a supply air fan ZUL connected to the outlet side of the air conditioning unit KLG.

The air conditioning unit KLG serves to condition and regulate the temperature of the supply air ZL delivered. The supply air fan ZUL on the outlet side delivers the conditioned supply air ZL to the interior IR of the rail vehicle via a ducting system KS1.

Via the ducting system KS2 described above a proportion of the conditioned air returns from the interior IR of the rail vehicle to the mixer M as circulating air UL.

In this closed overall system, however, pressure losses occur which are caused by the components described (air conditioning unit KLG, supply air fan ZUL, ducting systems KS1, KS2 and interior IR).

These pressure losses must be compensated for by the supply air fan ZUL, so that its capacity and size are dependent upon the anticipated pressure losses.

Depending on the magnitude of the actual pressure losses, the capacity of the supply air fan ZUL may sometimes be overtaxed, increasing its maintenance requirements and/or reducing its service life.

FIG. 6 shows an improved, known diagram of the air conditioning system represented in FIG. 5.

Here an additional circulating air fan UML with circulating air intake is connected to the inlet side of the mixer M, so that pressure losses on the circulating air-side are compensated for by the powerful, additional circulating air intake.

However, any additional or higher capacity fans (circulating air fans, supply air fans) that are needed increase the power consumption of the resulting overall system and the costs of the air conditioning assembly that ensues from this.

SUMMARY OF THE INVENTION

The object of the present invention, therefore, is to specify an improved assembly for the air conditioning of a rail vehicle.

This object is achieved by the claimed invention.

Advantageous developments are described in the respective dependent claims.

As its principal item, the assembly according to the invention focusses on a mixer for use in an air conditioning assembly of a rail vehicle.

The mixer comprises a first inlet, a second inlet, an outlet and a central area, which is located between the two inlets and the outlet.

The first inlet is connected to a fresh air supply, so that fresh air reaches the central area via the first inlet.

The second inlet is connected to a circulating air supply, so that circulating air reaches the central area via the second inlet.

In the central area the circulating air delivered and the fresh air delivered are mixed to generate supply air, which passes to the outlet of the mixer.

The central area of the mixer is connected via an opening to the first inlet. The opening forms a transitional area between the inlet and the central area, so that the fresh air delivered is fed from the first inlet to the central area via the transitional area.

According to the invention the transitional area contains a profile having an airfoil-shaped cross section. The profile is arranged in the transitional area in such a way that the fresh air delivered generates a negative pressure along the transitional area which boosts the induction of circulating air into the central area of the mixer.

The present invention is based on an efficient and reconfigured introduction of fresh air into the mixer.

The fresh air introduced is led over a profile with airfoil cross section into the mixer, so that a Coanda effect is produced along the profile. The term Coanda effect denotes the tendency of a gas flow to run along a convex surface of the airfoil-shaped profile (instead of detaching itself therefrom) and to continue moving in an original direction of flow at accelerated speed. In the interaction between the fresh air flowing along the airfoil profile and the circulating air, a negative pressure is formed on the circulating air-side of the mixer, which then boosts the induction of circulating air into the interior of the mixer (advantageous use is therefore made of an injector principle).

In one preferred development a fresh air fan is connected to the first inlet of the mixer. The fresh air fan draws in fresh air, pressurizes this and delivers the pressurized fresh air to the mixer via the first inlet of the mixer.

This further intensifies the negative pressure formed on the circulating air-side.

In one preferred development the fresh air fan is designed as a side-channel compressor. A side-channel compressor has a high pressure gain for a low volumetric flow and thereby a steep characteristic curve. Such a side-channel compressor easily overcomes pressure losses and delivers the fresh air efficiently into the mixer, in order to afford an additional boost to its circulating air intake.

Through the assembly according to the invention, the fresh air is introduced into the mixer in an aerodynamically efficient manner. A straightforward and cost-effective circulating air intake is thereby achieved in the mixer, which serves to compensate for any pressure losses in an air conditioning assembly.

The efficient introduction of the fresh air into the mixer using the "Coanda effect" generates an additional pressure boost in the mixer which works to the benefit of the air conditioning assembly.

The additional use of a mechanical circulating air fan that has hitherto been necessary, or a higher-capacity circulating air fan, is thereby avoided.

The present invention affords advantages in terms of the overall efficiency of the air conditioning assembly, since overall less electrical power is needed for its operation.

The present invention affords advantages in terms of the overall space needed, since components hitherto needed can be dispensed with or can be designed with a smaller overall size.

The present invention also affords advantages in terms of the acoustics, since the mixer according to the invention does not have any moving and thereby noise-generating components.

The present invention uses a fresh air fan to deliver fresh air at an increased pressure to the inlet side of the mixer. This assists the delivery of circulating air into the mixer. The intake of circulating air through the mixer is thereby boosted.

The present invention is explained in detail below by way of example referring to a drawing, in which:

DETAILED DESCRIPTION OF THE INVENTION

Figure 1:
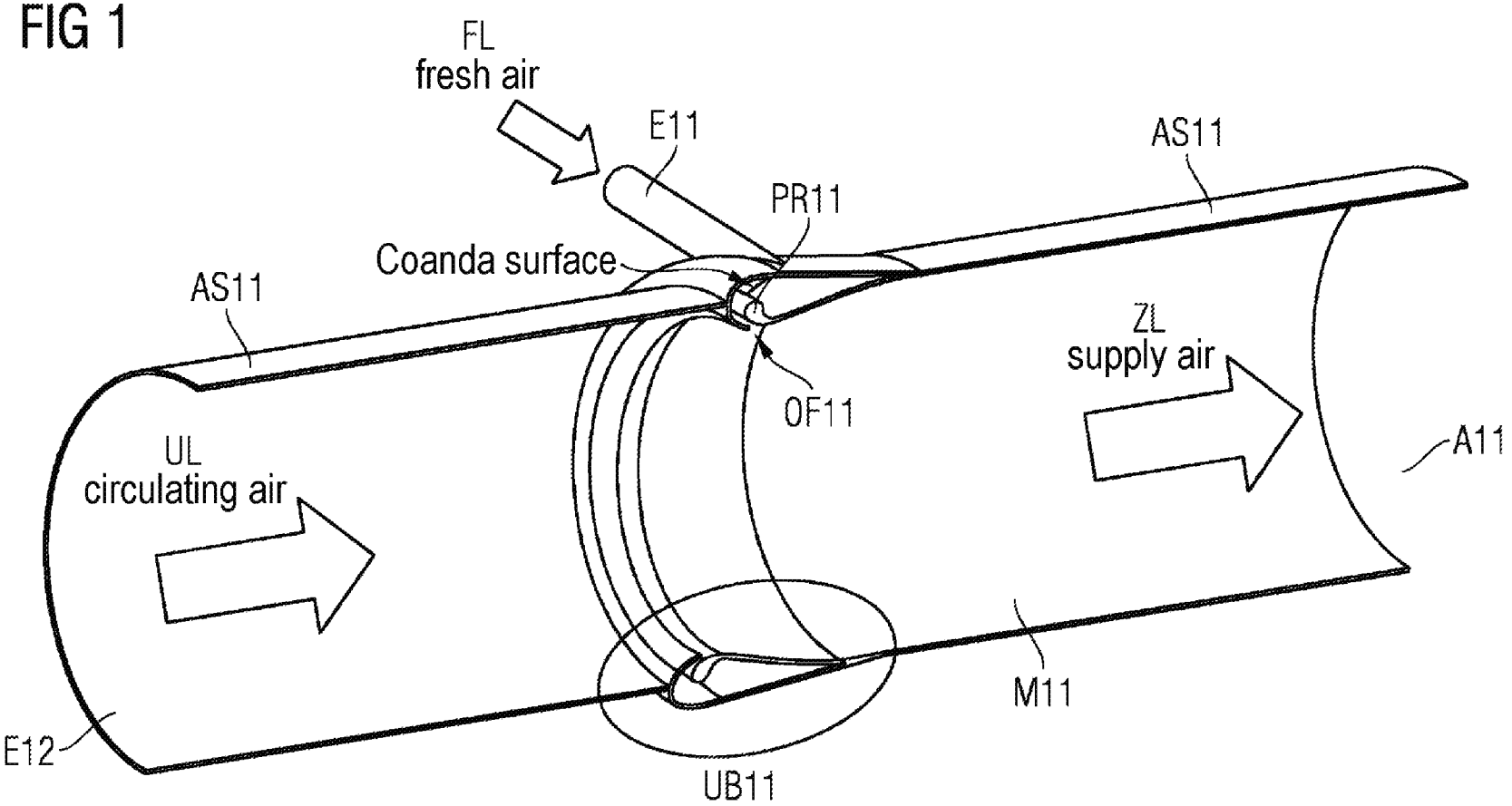
FIG. 1 shows one embodiment of a mixer according to the invention.

FIG. 1 shows one embodiment of the mixer M11 according to the invention.

The mixer M11 comprises a first inlet E11, a second inlet E12 and an outlet A11. The mixer M11 further comprises a cylindrical central area B11.

Fresh air FL is delivered to a mixer M11 via the first inlet E11 and circulating air UL via the second inlet E12.

In the cylindrical central area B11 the fresh air FL is mixed with the circulating air UL and from these supply air ZL is generated.

The first inlet E11 is formed as a tube, which is arranged radially to the circumference on the outside AS11 of the mixer M11 and which accordingly opens, radially to the circumference, into the interior of the mixer M11 in the direction of the central area B11.

This opening OF11 therefore forms a circumferential transitional area UB11, which is located between the inlet E11 and the cylindrical central area B11.

The circumferential transitional area UB11 contains a profile PR11, which has an airfoil-shaped cross section, which is described in more detail below.

Figure 2:
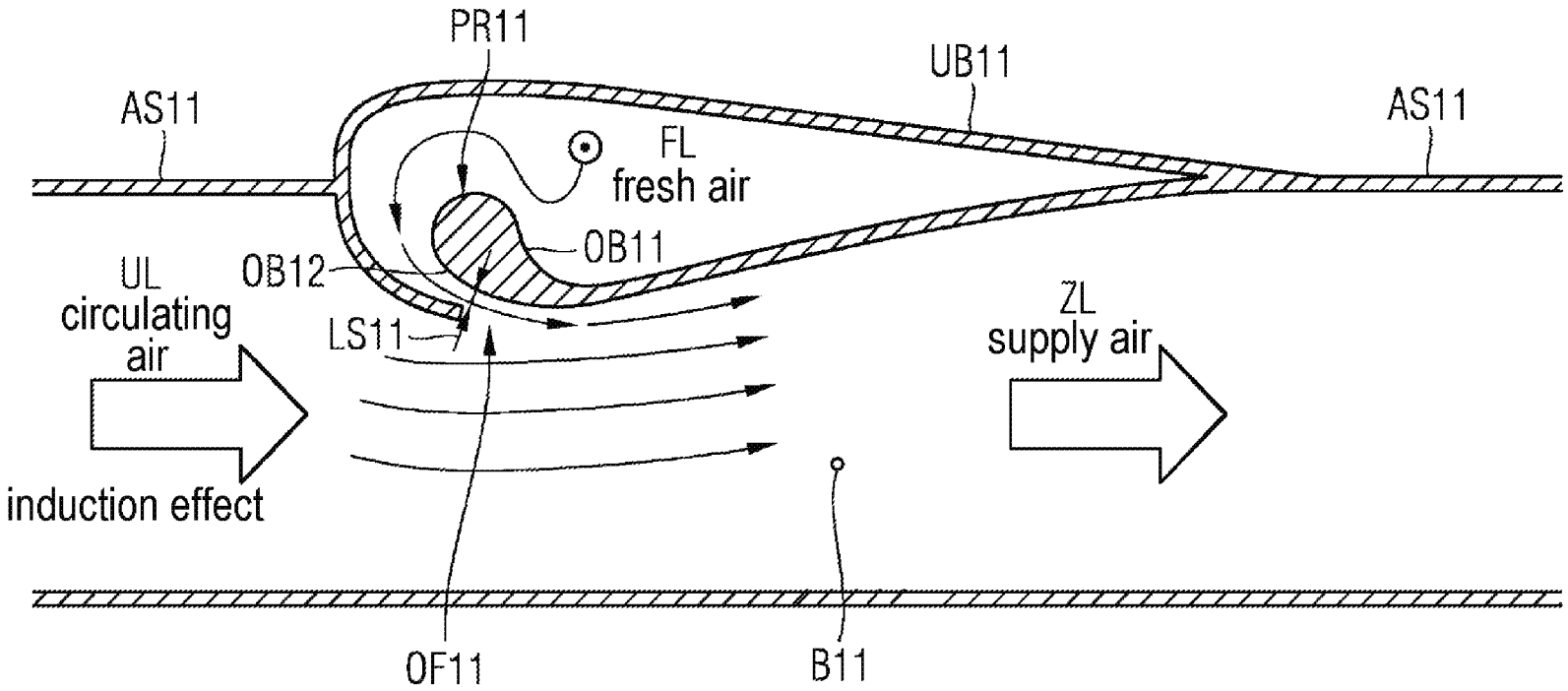
FIG. 2 referring to FIG. 1, shows a detail of the mixer according to the invention, FIG. 3 referring to FIG. 1 and FIG. 2, shows an advantageous enlargement of the mixer according to the invention.

FIG. 2, referring to FIG. 1, shows a detail of the mixer M11 according to the invention in a sectional representation.

The airfoil-shaped cross section of the profile PR11 has a concave, that is to say inwardly curved surface OB11 in the direction of the fresh air FL delivered or in the direction of the first inlet E11.

The airfoil-shaped cross section of the profile PR11 has a convex, that is to say outwardly curved surface OB12 in the direction of the circulating air UL delivered or in the direction of the cylindrical central area B11.

The outwardly curved surface OB12 of the profile PR11 is arranged opposite the opening OF11 and is separated from this by a (slight) air gap LS11.

The transitional area UB11 thereby has the function of an injector.

The fresh air FL delivered produces a negative pressure along the transitional area UB11, which serves to boost the induction of circulating air UL into the mixer M11 or into its central area B11.

The airfoil-shaped cross section of the profile PR11 therefore imparts a suction effect to the circulating air.

Figure 3:
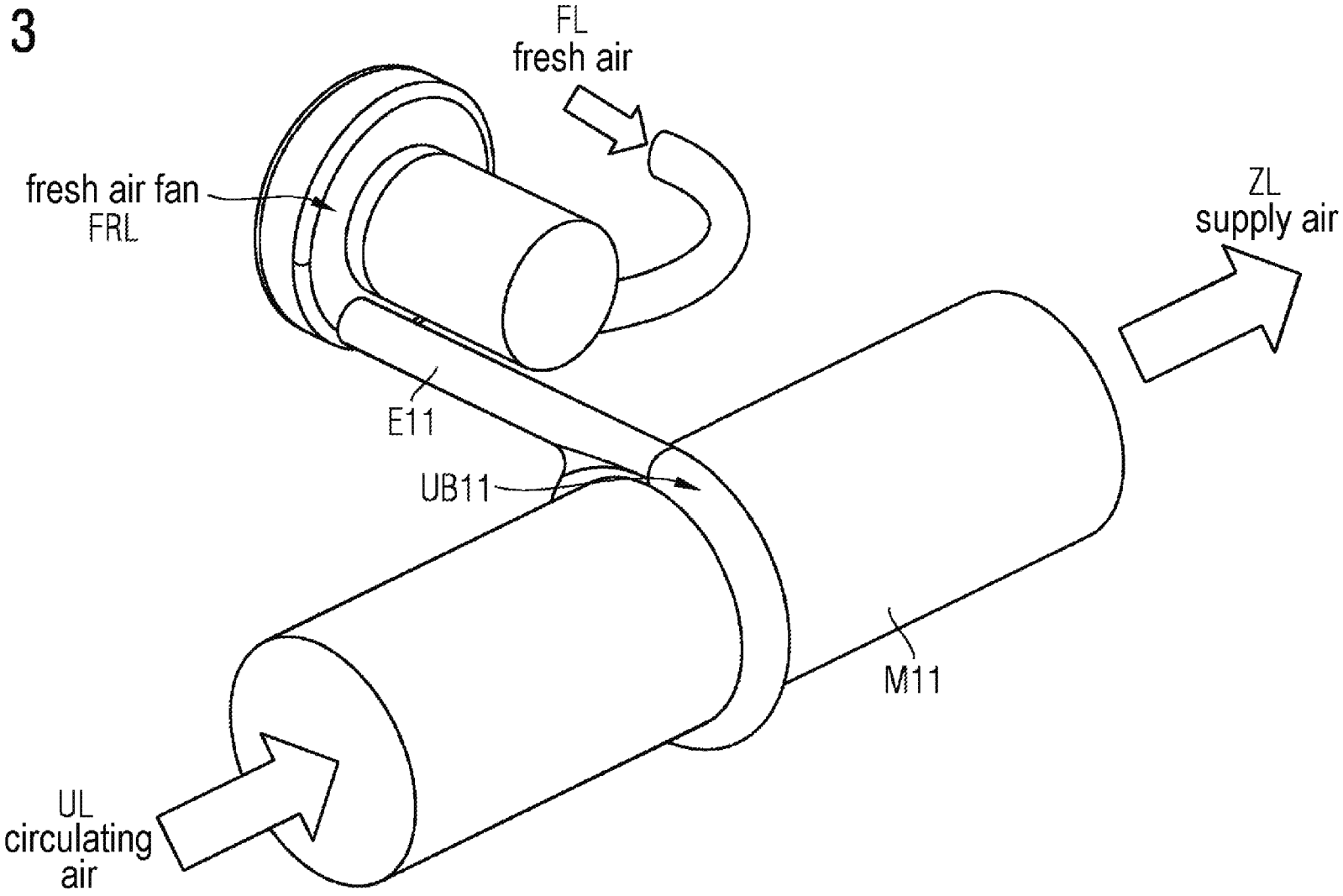

FIG. 3, referring to FIG. 1 and FIG. 2, shows an advantageous enlargement of the mixer M11 according to the invention.

Here a fresh air fan FRL is connected to the first inlet E11 of the mixer M11. The fresh air fan draws in fresh air FL, pressurizes this and delivers the pressurized fresh air FL to the mixer M11 via the first inlet E11 of the mixer M11.

The fresh air fan FRL is designed, in particular, as a side-channel compressor. A side-channel compressor has a high pressure gain for a low volumetric flow and thereby a steep characteristic curve.

This side-channel compressor easily overcomes pressure losses and delivers the fresh air FL efficiently into the mixer M11, in order to afford an additional boost to its circulating air intake.

Figure 4:
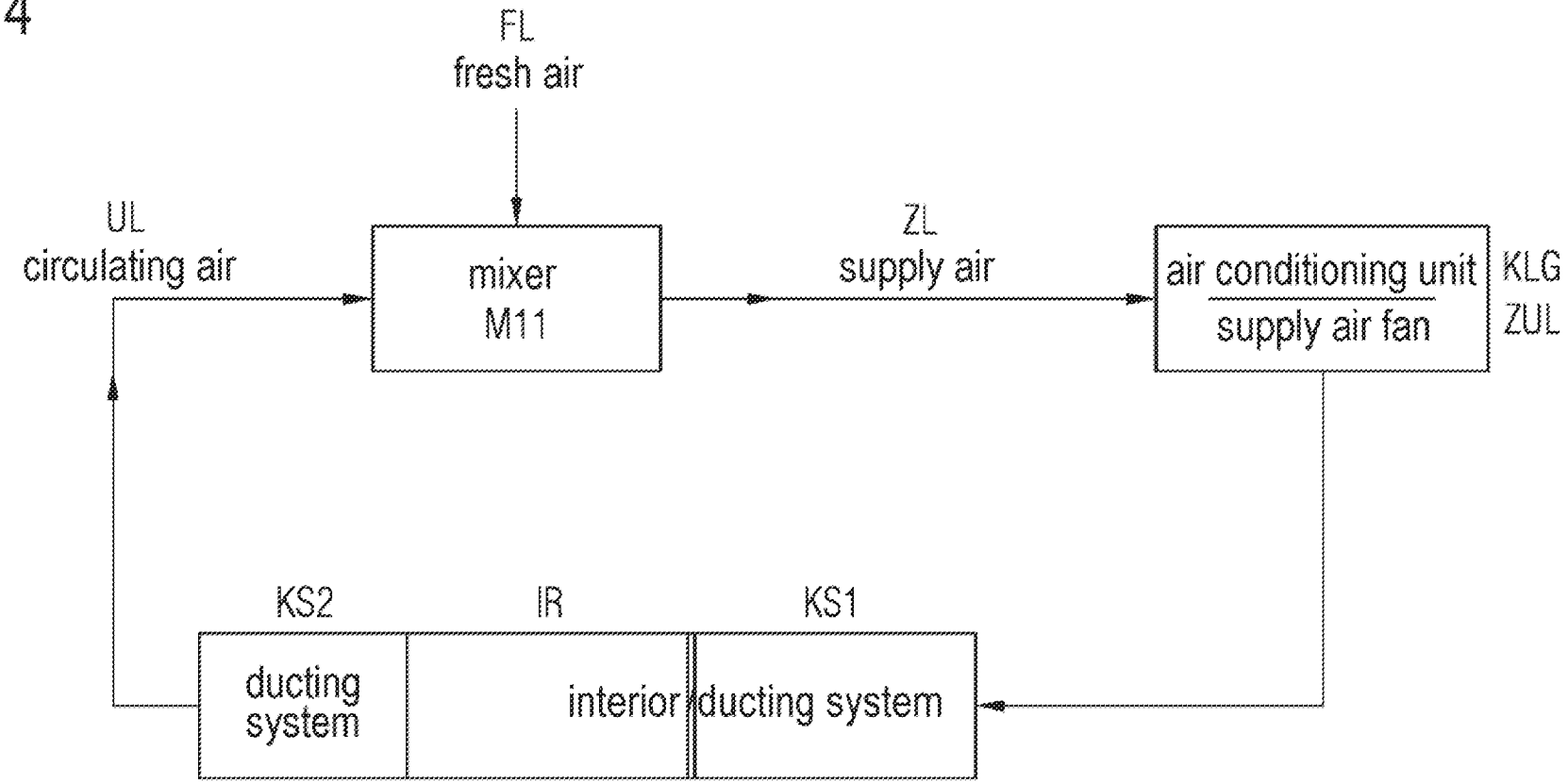
FIG. 4 shows an air conditioning diagram of a rail vehicle using the mixer according to the invention.
Figure 5:
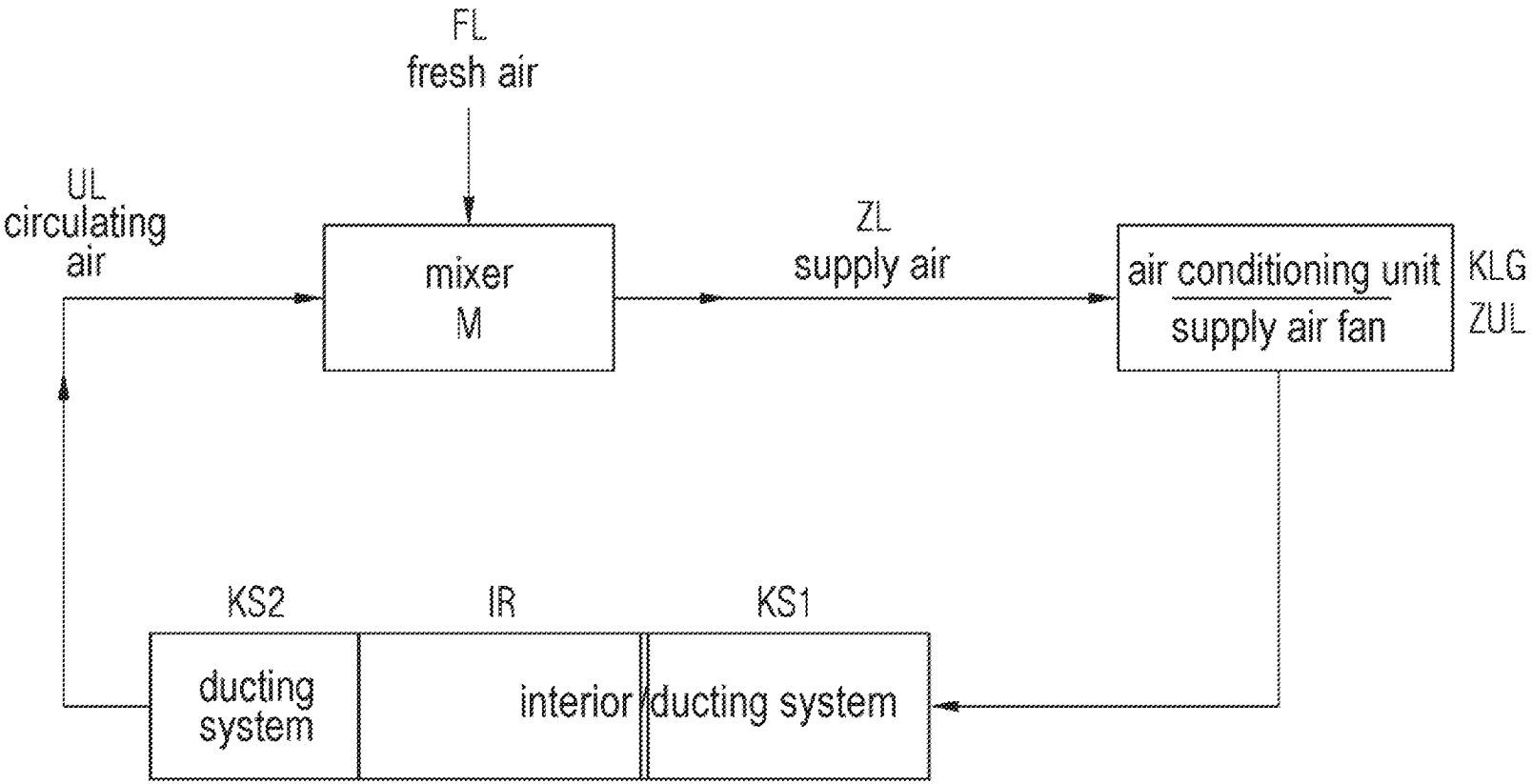
FIG. 5 shows the first air conditioning diagram according to the prior art described in the introductory part of the description.
Figure 6:
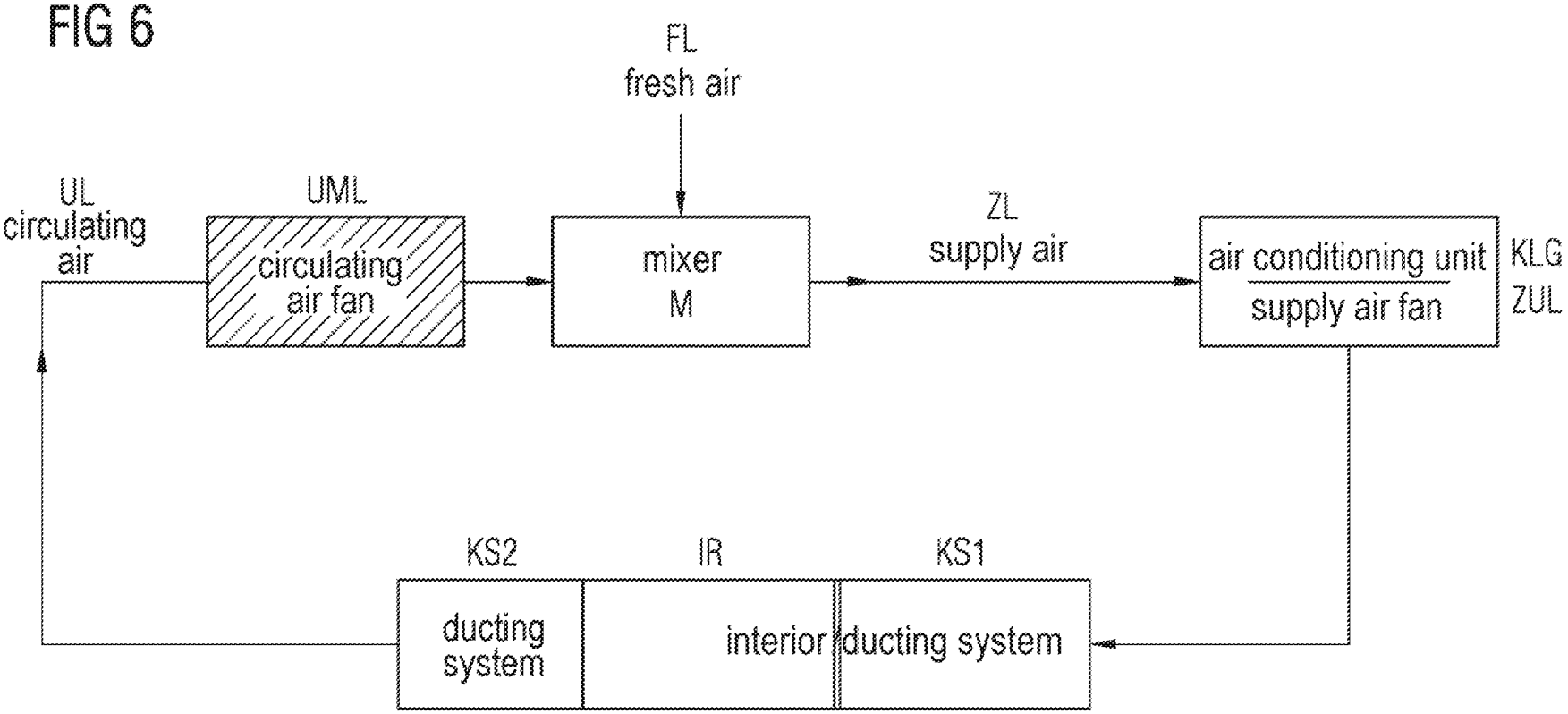
FIG. 6 shows the second air conditioning diagram according to the prior art described in the introductory part of the description.

FIG. 4 shows an air conditioning diagram of a rail vehicle using the mixer M11 according to the invention.

Fresh air FL is delivered to the mixer M11 via a first inlet and circulating air UL via a second inlet. The circulating air UL here originates from the interior IR of the rail vehicle and is delivered to the mixer M11 by means of a ducting system KS2. The fresh air FL is obtained from the external surroundings of the rail vehicle and is likewise delivered to the mixer M11.

The mixer M11 mixes the circulating air UL delivered with the fresh air FL delivered, and from these generates so-called supply air ZL.

Via an outlet of the mixer M11 the supply air ZL is delivered to an air conditioning unit KLG and to a supply air fan ZUL connected to the outlet side of the air conditioning unit KLG.

The air conditioning unit KLG serves to condition and regulate the temperature of the supply air ZL delivered.

By means of the supply air fan ZUL on the outlet side the conditioned supply air ZL is delivered to the interior IR of the rail vehicle via a ducting system KS1.

Via the ducting system KS2 described above a proportion of the conditioned air returns from the interior IR of the rail vehicle to the mixer M as circulating air UL.

LIST OF REFERENCE NUMERALS

M mixer
KLG air conditioning unit
ZUL supply air fan
UML circulating air fan
KS1 ducting system
KS2 ducting system
IR interior of a rail vehicle
M11 mixer
E11 first inlet of the mixer M11
E12 second inlet of the mixer M11
A11 outlet of the mixer M11
B11 central area of the mixer M11

FL fresh air
UL circulating air
ZL supply air
AS11 outside of the mixer M11
UB11 transitional area
OF11 opening in the transitional area UB11
PR11 profile
OB11 concave surface of the profile PR11
OB12 convex surface of the profile PR11
LS11 air gap between the convex surface OB12 and the opening OF11
FRL fresh air fan

The invention claimed is:

1. A mixer for an air conditioning assembly of a rail vehicle, the mixer comprising:

two inlets, being a first inlet and a second inlet, an outlet, and a cylindrical central area between the two inlets and said outlet, said first inlet being connected to a pressurized fresh air supply with a fresh air fan configured to draw in fresh air, to pressurize the fresh air, and to enable pressurized fresh air to reach said central area via said first inlet;

said second inlet being connected to a pressurized circulating air supply having a circulating air fan configured to draw in circulating air from an interior of the rail vehicle, to pressurize the circulating air and enable the circulating air to reach said central area via said second inlet;

wherein the circulating air and the fresh air are mixed in the central area to generate supply air, which passes to said outlet;

said central area being connected to said first inlet via an opening, which forms a circumferential transitional area between said first inlet and said central area, wherein the fresh air is fed from said first inlet to said central area via said transitional area;

said transitional area containing a profile having an airfoil-shaped cross section, said profile being arranged in said transitional area to cause the fresh air to generate a negative pressure along said transitional area to boost an induction of the circulating air into said central area;

said first inlet being a tube arranged radially about a circumference on an outside of the mixer;

said tube being formed with an opening that opens radially to the circumference in a direction of said central area and towards an interior of the mixer and which forms the circumferential transitional area between said inlet and said cylindrical central area.

2. The mixer according to claim 1, wherein:

the airfoil-shaped cross section of said profile has a surface curved inwardly in a direction of the fresh air or in a direction of said first inlet;

the airfoil-shaped cross section of said profile has a surface curved outwardly in a direction of the circulating air or in a direction of said cylindrical central area; and, said outwardly curved surface of said profile is arranged opposite said opening and separated therefrom by an air gap.

3. The mixer according to claim 1, wherein said fresh air fan is configured to draw and pressurize the fresh air before the fresh air reaches said first inlet.

4. The mixer according to claim 3, wherein said fresh air fan is a side-channel compressor.

5. An air-conditioning assembly for a rail vehicle, the assembly comprising:

a mixer according to claim 1, configured to generate supply air from the fresh air, which is delivered to the mixer by the fresh air fan via the first inlet, and the circulating air, which is delivered to the mixer by the circulating air fan via the second inlet;

said mixer having an outlet side connected to an air conditioning unit, wherein the supply air is delivered to said air conditioning unit for generating conditioned supply air and adjusting an air temperature;

a supply air fan connected to an outlet side of said air conditioning unit for delivering the conditioned supply air via a ducting system into an interior of the rail vehicle; and the interior of the rail vehicle communicating with the second inlet of said mixer via the ducting system and the circulating air fan, so that at least a proportion of the conditioned supply air passes via said ducting system from the interior to the second inlet of said mixer as the circulating air.

* * * * *